United States Patent [19]

Gentry et al.

[11] Patent Number: 4,589,719

[45] Date of Patent: May 20, 1986

[54] WALL PLATE ASSEMBLY FOR IN-LINE ELECTRICAL COUPLING

[75] Inventors: John M. Gentry, Candler; Lee A. Archer, Asheville, both of N.C.

[73] Assignee: Brand-Rex Company, Willimantic, Conn.

[21] Appl. No.: 649,137

[22] Filed: Sep. 10, 1984

[51] Int. Cl.[4] ..... H01R 13/426

[52] U.S. Cl. ..... 339/126 R

[58] Field of Search ..... 339/126 R, 128

[56] References Cited

U.S. PATENT DOCUMENTS

| | | | |
|---|---|---|---|
| 1,731,661 | 10/1929 | Hauenstein | 339/126 R |
| 2,715,216 | 8/1955 | Howenstine | 339/126 R |
| 3,002,175 | 9/1961 | Bertram et al. | 339/126 R |
| 3,315,215 | 4/1967 | Kulka | 339/126 R |
| 3,793,613 | 2/1974 | Reichert | 339/126 R |
| 4,120,555 | 10/1978 | Shiflett et al. | 339/126 R |

FOREIGN PATENT DOCUMENTS

| | | | |
|---|---|---|---|
| 1435722 | 3/1966 | France | 339/126 R |

*Primary Examiner*—Joseph H. McGlynn

*Attorney, Agent, or Firm*—McCormick, Paulding & Huber

[57] ABSTRACT

There is provided an electrical coupling assembly which utilizes an in-line electrical coupling device mounted through a hole in a standard wall face plate. The coupling is adapted to receive a modular plug on each end. Grooves are provided on portions of the body of the coupling for receiving C-shaped spring clips on either side of the plate for securing the coupling to the plate.

10 Claims, 9 Drawing Figures

WALL PLATE ASSEMBLY FOR IN-LINE ELECTRICAL COUPLING

BACKGROUND OF THE INVENTION

This invention relates to electrical connectors. More particularly, it relates to modular plugs and couplings which are adapted for quick connections and disconnections for data and telephone service in buildings.

In an effort to standardize interface dimensions for electrical connectors, particularly in the telephone industry, the Federal Communications Commission has issued regulations regarding such dimensions. In view of this standardization, the telephone and computer industry has been utilizing modular plugs terminated to cable for various interconnection uses. A typical modular plug is described in U.S. Pat. No. 3,617,982 issued to Hardesty and U.S. Pat. No. 3,699,498 issued Oct. 17, 1972 also issued to Hardesty and are hereby incorporated herein by reference. A standard FCC modular plug may also be seen as item 10 in referring to FIG. 1 herein. U.S. Pat. No. 4,367,908 issued Jan. 11, 1983 and assigned to the Brand-Rex Company, assignee of the present invention and which is also hereby incorporated by reference, shows an in-line adapter for connecting a pair of modular plugs which are, in turn, terminated to electrical cable. An example of such in-line adapter is shown in FIG. 1 herein, where FCC modular plug 10 is connected to FCC modular plug 12. The modular plugs 10 and 12 terminate multi-pair cables 14 and 16. The in-line adapter 18 includes plastic housing 20 and a plurality of electrical contacts 22. These contacts 22 have free ends 24 and 26 which are secured in the plastic of housing 20. As can be seen, the contacts 22 form a diagonal across the bore cavity 28 of the housing and make electrical contact with the respective contacts in modular plugs 10 and 12. While the in-line adapter which is the subject of U.S. Pat. No. 4,367,908 has found many uses in the modular plug interconnection field, there are certain applications where the adapter has not found utility.

OBJECTS OF THE INVENTION

It is therefore one object of this invention to provide an improved electrical coupling assembly.

It is another object to provide an electrical coupling assembly which will enable one to quickly connect and disconnect building transmission cable to peripheral equipment.

It is still another object to provide an electrical coupling for use with modular plugs in an office or home environment which may be used with various sizes of face plates.

SUMMARY OF THE INVENTION

In accordance with one form of this invention there is provided an electrical coupling assembly including a wall-mountable plate having at least one hole therethrough. At least one coupling is provided and includes a housing having a bore therethrough. A plurality of electrical contacts are received in the bore. The coupling has a pair of open ends which are adpated to receive and secure thereto a first and a second modular plug. Thus, electrical signals may be transmitted from the first modular plug to the second modular plug. A mechanism is provided for securing the coupling to the plate. In one embodiment of the invention a pair of C-shaped spring clips are received in grooves about portions of the housing on both sides of the plate for securing the coupling to the plate. The free ends of the C-shaped spring clips may be tapered so that the clips may be easily slipped over the housing during assembly. The groove on one side of the plate may be wider than the groove on the other side of the plate to accommodate various thicknesses of plates. In the case of a rather thin plate a portion of the spring clip which is received in the larger groove may be bent somewhat so as to more readily secure the coupling to the plate.

BRIEF DESCRIPTION OF THE DRAWINGS

The subject matter which is regarded as the invention is set forth in the appended claims. The invention itself, however, with further objects and advantages thereof may be better understood by referring to the following description taken in conjunction with the following drawings in which:

DESCRIPTION OF THE PREFERRED EMBODIMENT

Figure 1:
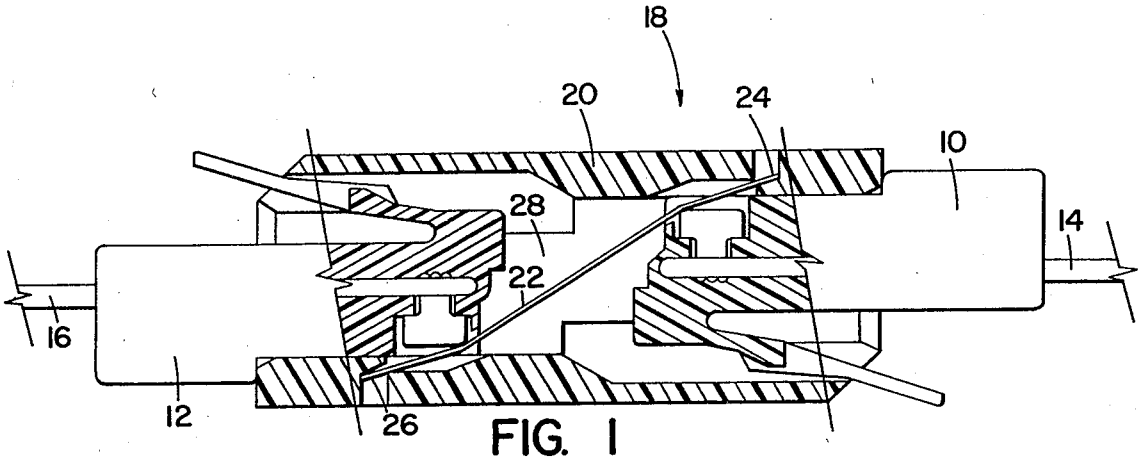
FIG. 1 PRIOR ART
FIG. 1 shows a prior art in-line adapter.
Figure 2:
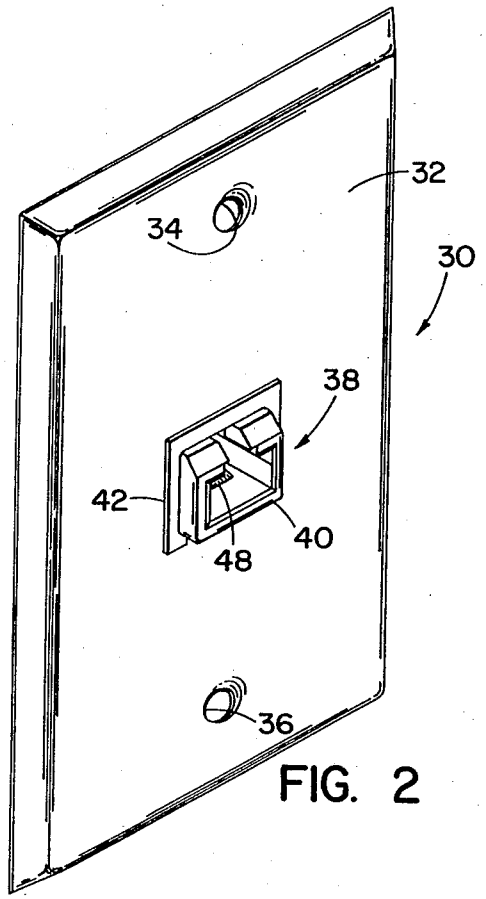
FIG. 2 is a pictorial view of primarily the front side of the coupling assembly of the subject invention.

Referring now more particularly to FIG. 2, there is provided in-line coupling face plate assembly 30, including face plate 32 having a pair of mounting holes 34 and 36. The face plate 32 is adapted to be mounted onto a standard electrical box (not shown) which has a modular plug terminating a transmission cable received therein, such as modular plug 10 and transmission cable 14 shown in FIG. 1. Face plate 32 has a hole 38 punched therethrough for receiving an in-line elongated coupling device 40. The in-line coupling device may be a modified in-line adapter described, in its unmodified state, in U.S. Pat. No. 4,367,908 and commercially available, again in its unmodified state, from the Brand-Rex Company. A C-shaped spring clip 42 surrounds a portion of the outer periphery surface of the housing of the elongated coupling 40. The coupling is adapted to fit somewhat loosely in the opening 38 of the face plate for ease of assembly. The C-shaped spring clip 42 is firmly coupled to the housing of the coupling and with its substantial width prevents the coupling from sliding backward through the hole in the face plate.

Figure 3:
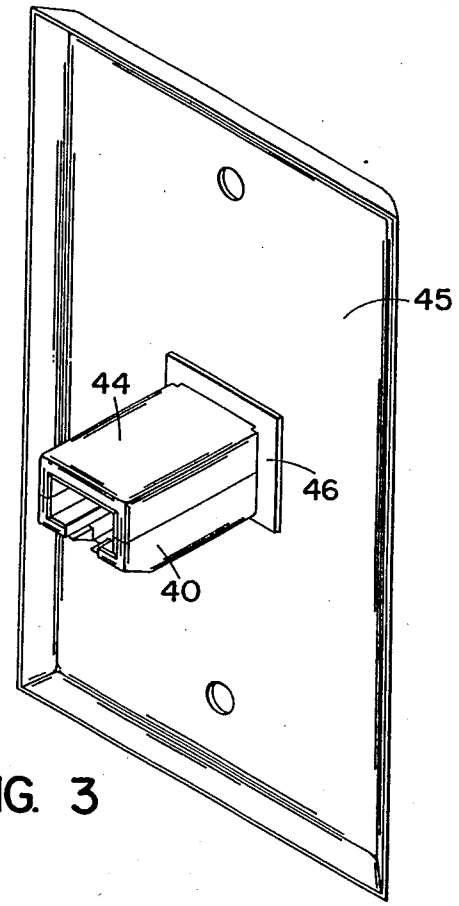
FIG. 3 is a pictorial view showing primarily the back side of the coupling of FIG. 2.

Referring now to FIG. 3, the elongated back side 44 of coupling 40 projects from the rear 45 of face plate 32. A second C-shaped spring clip 46 which may be substantially the same as spring clip 42 is also attached to the outer portion of the housing of coupling 40. This spring clip 46 prevents the coupling from sliding through hole 42 towards the front side of the face plate.

Figure 4:
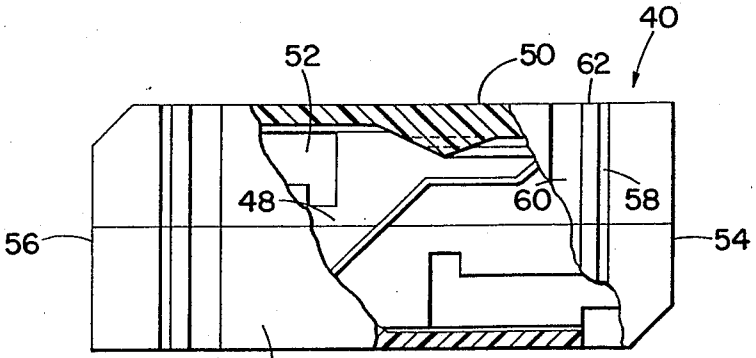
FIG. 4 shows the coupling of FIG. 2 which has been removed from the face plate.

As can be seen from FIG. 2 and FIG. 4, a plurality of electrical contacts 48 are provided through coupling 38 in a similar fashion to the contacts 22 shown in FIG. 1.

Referring again to FIG. 4, coupling 38 includes housing 50 having a bore hole 52 therethrough. A pair of end openings 54 and 56 are provided for receiving modular plugs which are adapted to contact electrical contacts 48. A pair of grooves 58 and 60 are provided about a portion of the outer periphery of housing 50. These grooves are adapted to receive C-shaped spring clamps 42 and 46. The area 62 which is about the complete circumference of coupling 38 between grooves 58 and 60, is adapted to align with and contact the surfaces of the plate 32 which form hole 38. Grooves 58 and 60 preferably do not extend all the way around the periphery of the housing. Preferably the grooves do extend along each side of the housing. The top surface 64 of the housing may be seen in reference to FIG. 4 and the bottom surface 66 of the housing may be seen in reference to FIG. 9.

Figure 9:
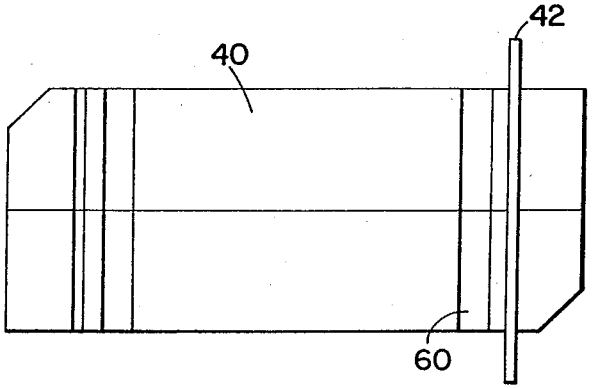
FIG. 9 shows a side elevational view of the coupling of FIG. 4 with one of the C-shaped clips attached thereto.

As can be seen from FIG. 9, grooves 58 and 60 comprise two sets of grooves, which open outwardly through opposite sides of the housing and stop short of extending all the way across the bottom surface. Thus tangs 68 and 70 which are at the free ends of C-shaped spring clip member 42 are adapted to be received in the short grooves 72 and 74 in the case of groove 60, and short grooves 76 and 78 in the case of groove 58. These tangs and short grooves on the bottom of the housing help capture the C-shaped spring clip member onto the housing after assembly. Shoulders 80 and 82 will rest in the short grooves on the bottom of the housing. It should be noted that the tangs include beveled portions 84 and 86. This beveling helps enable one to easily assembly the C-clips over the housing while springing open the clip and snapping it over the edge of the housing once it has cleared the groove in the housing.

Figure 6:
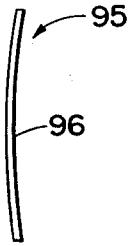
FIG. 6 is a side elevational view of an alternative embodiment of the the spring clip of FIG. 5.
Figure 5:
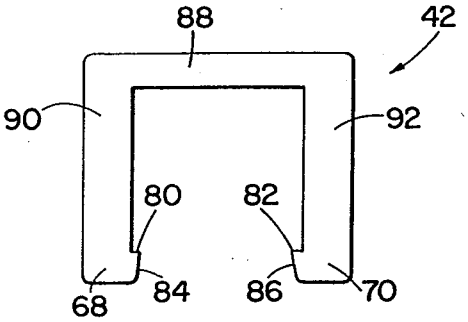
FIG. 5 is a plan view of one embodiment of the spring clip shown in FIG. 2.

It should be noted from FIGS. 4 and 9 that groove 60 is somewhat wider than groove 58, which groove 58 being only slightly wider than the thickness of the spring clip and groove 60 being about twice as wide. This feature of having the one groove wider than the other is provided so that various thicknesses of face plates 32 may be used while utilizing standardized couplings and C-clips. If a very thin face plate is utilized, it is preferred that a curved C-clip such as the one shown in FIG. 6 it utilized. As can be seen from FIG. 5, clamp 42 is somewhat of a squared shape having central portion 88 and two legs 90 and 92. However, in the embodiment of FIG. 6 the central portion is curved and bent back somewhat. That bent portion 96 may be more readily seen in reference to FIG. 6 which shows a side elevational view of the modified C-clip.

Figure 8:
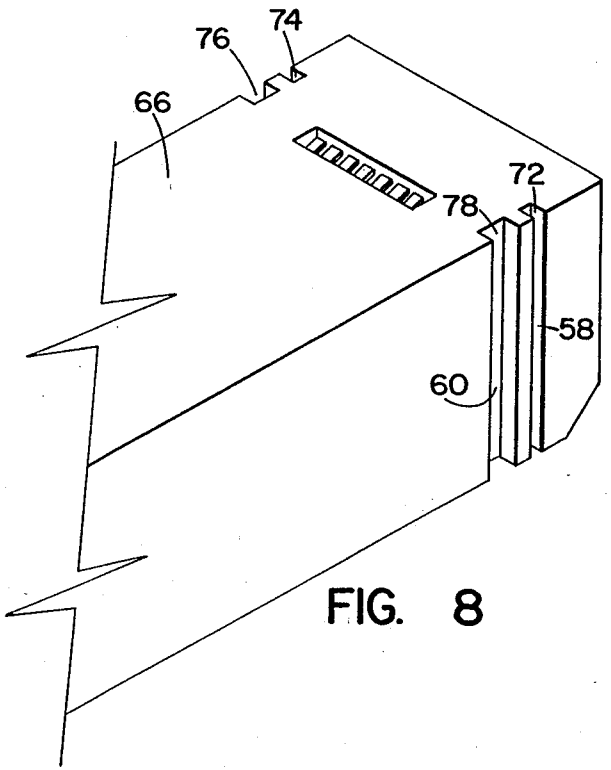
FIG. 8 shows a partial pictorial view of the bottom side of the coupling of FIG. 4.
Figure 7:
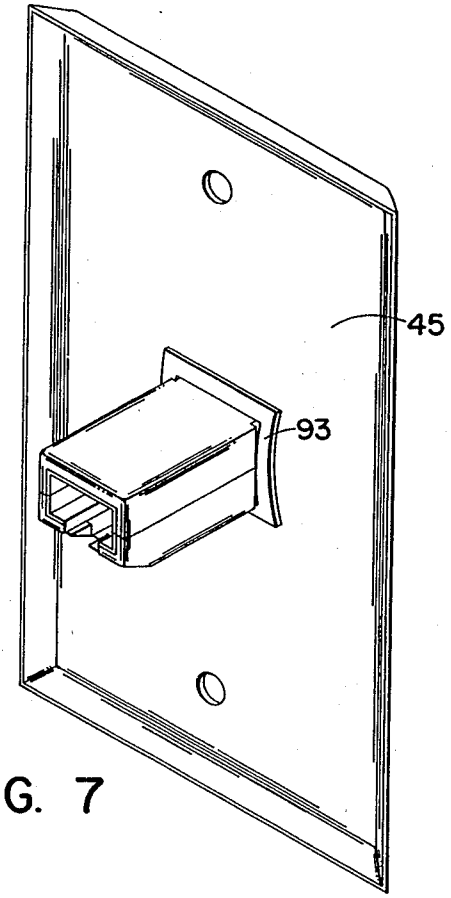
FIG. 7 is a partial pictorial view of the rear side similar to FIG. 2 but utilizing the spring clip of FIG. 6.

As can be seen from FIG. 8, with the modified bent C-clip 93 being utilized, the periphery portions will firmly press against the back side 45 of cover plate 32 and provide a spring force to prevent the coupling from being loosely received in the hole 38 of the cover plate. A comparison of the width of groove 60 to the width of C-clamp 42 may also be seen in reference to FIG. 10, where a straight C-clip 42 has been mounted in groove 58 but not mounted in groove 60.

From the foregoing description of the preferred embodiments of the invention it will be apparent that many modifications may be made therein. It will be understood, therefore, that these embodiments are intended as exemplification of the invention only and the invention is not limited thereto. It is to be understood, therefore, that it is intended in the appended claims to cover all such modifications which fall within the true spirit and scope of the invention.

We claim:

1. An electrical coupling assembly comprising:

a wall-mountable plate having at least one hole therethrough; a coupling including a housing having a bore therethrough; said coupling received in and extending through said hole; a plurality of electrical contacts received in said bore;

said coupling having a pair of open ends; said ends adapted to receive and secure thereto a first and a second modular plug wherein electrical signals may be transmitted from the first plug to the second plug; and means for securing said coupling to said plate including first and second sets of grooves in said housing, the grooves of each of said sets opening outwardly through opposite sides of said housing, the grooves of said second set being substantially wider than the grooves of said first set, and a pair of generally C-shaped clips, each of said clips having a pair of spaced apart legs connected together by a central portion, said clips staddling said housing at opposite sides of said plate, one of said clips having portions of the legs thereof received within the grooves of said first set, the other of said clips being a spring clip having bowed legs received within the grooves of said second set and acting between said plate and said housing to bias said housing rearwardly relative to said plate.

2. An electrical coupling assembly as set forth in claim 1, wherein each leg includes a widened portion forming shoulders.

3. An electrical coupling assembly as set forth in 1, wherein said clips are sheet metal stampings.

4. An electrical coupling assembly as set forth in claim 3, wherein each of said legs has a widened portion forming shoulders.

5. An electrical coupling assembly as set forth in claim 4, further including a tapered portion from the free ends of each of said legs to the shoulder thereof.

6. In an electrical coupling assembly including a wall-mountable plate having a hole extending therethrough and opening through the front and rear faces of the plate, an electrical coupling for connecting a pair of electrical connectors located in front of and behind the plate and including an elongated housing received within and extending longitudinally through the hole and means for securing the electrical coupling in assembly with the plate the improvement wherein said securing means comprises a first set of grooves formed in said housing and opening transversely outwardly through opposite sides of said housing, a first mounting clip having a pair of legs straddling said housing, each of said legs of said first clip being received within an associated one of said grooves of said first set, said first mounting clip bearing against one of said faces including said front and rear faces, a second set of grooves formed in said housing and spaced from said first set, said grooves of said second set opening transversely outwardly through opposite sides of said housing, said grooves of said second set being of substantially greater width than said grooves of said first set, a second mounting clip having a pair of legs straddling said housing and received within said grooves of said second set, said second mounting clip acting between said housing and the other of said faces including said front and rear faces to bias said first mounting clip toward engagement with said one of said faces.

7. In an electrical coupling assembly as set forth in claim 6 the further improvement wherein said grooves comprise parallel grooves.

8. In an electrical coupling assembly as set forth in claim 6 the further improvement wherein said first mounting clip comprises a generally C-shaped flat metal stamping and said grooves of said first set have a width substantially equal to the thickness of said flat metal stamping.

9. In an electrical coupling assembly as set forth in claim 8 the further improvement wherein said second mounting clip comprise a generally C-shaped spring clip.

10. A wall-mountable in-line electrical connector assembly for joining a pair of modular plugs in in-line electrical connected relation to each other and comprising a wallmountable plate having a hole therethrough opening through the front and rear faces of said plate, an in-line electrical connector having a housing extending through said opening and projecting outwardly from and beyond each of said faces, said housing having a bore extending therethrough and defining plugreceiving openings at opposite ends of said housing, electrical contact means within said bore for establishing electrical connection between modular electrical plug connectors received in plugged relation within opposite ends of said bore, and means for retaining said in-line connector in assembled relationship with said wall-mountable plate and including a first set of grooves formed in said housing and opening outwardly through opposite sides of said housing, a first generally C-shaped mounting clip straddling said housing and having legs received within said grooves of said first set, said first clip bearing against one face of said plate and locating said housing in position relative to said plate, a second set of grooves in said housing spaced from said first set and opening outwardly through opposite sides of said housing, the grooves of said second set being substantially wider than the grooves of said first set, a generally C-shaped spring clip straddling said housing and having legs received within said grooves of said second set, said spring clip acting between said housing and said plate to bias said first mounting clip toward engagement with said one face.

* * * * *